US005388905A

United States Patent [19]

Ake et al.

[11] Patent Number: 5,388,905

[45] Date of Patent: Feb. 14, 1995

[54] POLYMER MIXING/ACTIVATION SYSTEM

[75] Inventors: Sam E. Ake, Aurora; Kieran F. O'Melia, Bedford, both of Ohio

[73] Assignee: Or-Tec, Inc., Bedford, Ohio

[21] Appl. No.: 40,372

[22] Filed: Mar. 30, 1993

[51] Int. Cl.[6] ..... B01F 15/02

[52] U.S. Cl. ..... 366/163; 137/13; 137/888; 137/896

[58] Field of Search ..... 366/150, 163, 336, 337, 366/338, 339, 340; 137/13, 888, 896

[56] References Cited

U.S. PATENT DOCUMENTS

| | | | |
|---|---|---|---|
| 2,583,206 | 1/1952 | Borck et al. . | |
| 3,188,055 | 6/1965 | Lutjens | 366/163 |
| 3,601,079 | 8/1971 | Giles | 137/13 |
| 3,682,446 | 8/1972 | Eron . | |
| 3,727,640 | 4/1973 | Sargeant . | |
| 3,728,129 | 4/1973 | Sargeant . | |
| 4,061,313 | 12/1977 | Brauner et al. . | |
| 4,121,906 | 10/1978 | Oldham et al. . | |
| 4,123,800 | 10/1978 | Mazzei . | |
| 4,204,775 | 5/1980 | Speer . | |
| 4,416,610 | 11/1983 | Gallagher | 137/888 |
| 4,664,528 | 5/1987 | Rodgers et al. . | |
| 4,722,363 | 2/1988 | Allyn | 137/888 |
| 5,011,292 | 4/1991 | Trapasso et al. . | |
| 5,067,508 | 11/1991 | Lee | 137/13 |
| 5,154,321 | 10/1992 | Shomer . | |

*Primary Examiner*—Robert W. Jenkins
*Attorney, Agent, or Firm*—Calfee, Halter & Griswold

[57] ABSTRACT

A polymer mixing/activation system comprising a liquid inlet line, a polymer inlet line, a mixer-ejector, an ejector outlet line, and a mixing/retention chamber. The liquid inlet line is connected to a source of pressurized liquid, such as a city water line. The polymer inlet line is connected to a source of emulsion polymer which, when mixed with the liquid and activated, forms a liquid/polymer solution suitable to attract, coagulate or flocculate suspended solids in a fluid, such as waste water. The liquid inlet line and the polymer inlet line are connected to the mixer-ejector. The mixer-ejector has passageways arranged and shaped so that when the liquid flows therethrough, a suction is created which draws the polymer into the mixer-ejector and simultaneously mixes the polymer with the liquid to form a liquid/polymer mixture. The upstream end of the ejector outlet line is connected to the mixer-ejector and a downstream end of the ejector outlet line is connected to the mixing/retaining chamber whereby the liquid/polymer mixture flows from the mixer-ejector to the mixing/retaining chamber. Thus, the system uses only the pressure of incoming liquid (i.e., pressurized city water) to regulate the introduction of the polymer. In this manner, a polymer mixing/activation system is provided which does not require a source of power, such as electricity, to operate.

19 Claims, 1 Drawing Sheet

POLYMER MIXING/ACTIVATION SYSTEM

FIELD OF THE INVENTION

This invention relates generally as indicated to a polymer mixing/activation system in which an emulsion polymer is added to a liquid, such as city water, to form a liquid/polymer solution. More particularly, the present invention relates to a polymer mixing/activation system which uses only incoming water pressure to regulate the introduction of the polymer. The liquid/polymer solution may be added to water or waste water (generally a sludge) for the coagulation or flocculation of suspended solids.

BACKGROUND OF THE INVENTION

In water treatment systems, a liquid/polymer solution is typically used to coagulate or flocculate undesired suspended solids in city waste water. More specifically, a polymer (which is made up of electrically charged molecules) is mixed with a liquid and thereby activated. This liquid/polymer solution is then added to a fluid containing suspended solids (i.e. city waste water, generally a sludge) for the coagulation or flocculation of the suspended solids. More particularly, the polymers attach themselves to the suspended solids to form larger particles which may then be effectively removed from the fluid. The proper introduction of polymers into, and the proper mixing of the polymers with, the liquid is usually critical to successfully forming the liquid/polymer solution. On the other hand, overly aggressive introduction and/or mixing may undesirably affect the coagulation/flocculation power of the polymer.

In the past, a typical polymer mixing/activation system included a large mixing/holding tank (i.e., 100 or more gallons). The liquid, such as water was pumped or otherwise transferred to this tank and an emulsion polymer was added. Thereafter, the liquid and the polymer were blended by a slow speed mixer designed for use with the tank whereby the polymers would be activated to form a liquid/polymer solution. After being retained for an appropriate time (i.e., fifteen minutes), the liquid/polymer solution was drained or otherwise removed from the tank for use in water treatment. While such systems proved effective, they required the use of a large mixing/holding tank, a slow speed mixer, and a variable speed chemical dosing pump.

In recent years, automatic polymer mixing/activation systems have been developed which eliminate the need for a large mixing/holding tank. However, these systems still require a chemical dosing pump for the introduction of the polymer. Additionally, such automatic systems usually include mixing devices, such as a flash mixer. Consequently, most polymer mixing/activation systems still require an outside source of power (i.e., electricity) to operate the pump and/or the mixing devices.

Applicants therefore believe that a need remains for polymer mixing/activation systems having components which do not require an outside source of power, such as electricity, to operate. Additionally or alternatively, applicants believe a need remains for more gentle and thorough polymer mixing/activation systems.

SUMMARY OF THE INVENTION

The present invention provides a polymer mixing/activation system having components which do not require a source of power, such as electricity, to operate. Specifically, the system uses only the pressure of incoming liquid (i.e., pressurized city water) to regulate the introduction of the polymer. In addition to eliminating the need for an outside power source, the system is also believed to provide a more gentle and thorough mixing of the liquid and the polymer.

More particularly, the present invention provides a polymer mixing/activation system comprising a liquid inlet line, a polymer inlet line, a mixer-ejector, an ejector outlet line, and a mixing/retention chamber. The liquid inlet line is adapted to be connected to a source of pressurized liquid (i.e., a city water line.) The polymer inlet line is adapted to be connected to a source of an emulsion polymer. The liquid inlet line and the polymer inlet line are connected to the mixer-ejector. The mixer-ejector has passageways arranged and shaped so that when the liquid flows therethrough, a suction is created which draws the polymer into the mixer-ejector and simultaneously mixes the polymer with the liquid to form a liquid/polymer mixture. The upstream end of the ejector outlet line is connected to the mixer-ejector and a downstream end of the ejector outlet line is connected to the mixing/retaining chamber whereby the liquid/polymer mixture flows from the mixer-ejector to the mixing/retaining chamber.

In the preferred embodiment, the mixing/retaining chamber has an approximately one gallon capacity and/or is sized to provide a $\frac{1}{2}$ to 1 minute retention of the liquid/polymer mixture. The mixing/retaining chamber preferably includes a first zone adjacent the chamber's entrance, a middle zone adjacent the first zone, and a final zone between the middle zone and the chamber's exit. Consequently, in the preferred embodiment, the liquid/polymer mixture travels from the ejector outlet line, through the entrance of the chamber, sequentially through the first, middle, and final zones, through the exit of the chamber, and into the chamber outlet line. The first zone and/or the final zone preferably comprise a manifold having gradually increasing (in the upstream direction) cone-shaped orifices. The middle zone preferably includes a series of substantially sphere-shaped objects which increase in size towards an upstream end of the zone. More preferably, the substantially sphere-shaped objects comprises plastic balls with diameters increasing from approximately $\frac{3}{8}$ inch to one inch.

Thus, a polymer mixing/activation system according to the present invention may comprise a city water line, a source of a polymer which, when mixed with such water and retained for a predetermined period of time, will be activated; and means for introducing the polymer into the water and for simultaneously mixing the polymer with the water to form a liquid/polymer solution which may be used in waste water treatment. This means uses only the water pressure whereby an outside power source is unnecessary. More particularly, the means consists essentially of a mixer-ejector having passageways arranged and shaped so that when the water flows therethrough a suction is created by the flow which draws the polymer into the mixer-ejector and simultaneously mixes the polymer with the water to form a water/polymer mixture.

These and other features of the invention are fully described and particularly pointed out in the claims. The following descriptive annexed drawings set forth in detail one illustrative embodiment. However this embodiment is indicative of but one of the various ways in which the principles of the invention may be employed.

BRIEF DESCRIPTION OF THE DRAWING

The annexed drawing is a schematic illustration of a polymer mixing/activation system according to the present invention.

DETAILED DESCRIPTION

Figure 1:
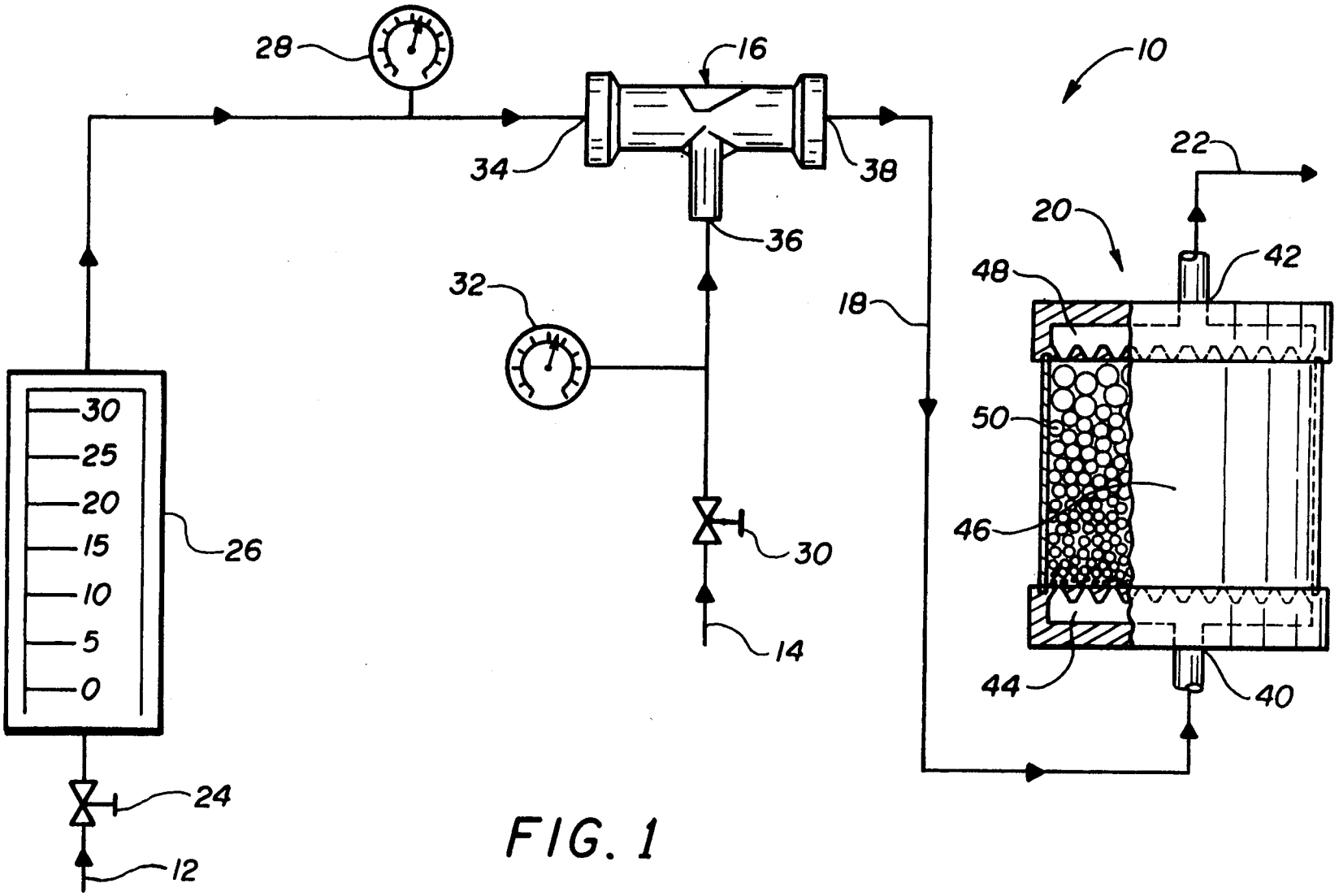

Referring now to the drawing in detail, a polymer mixing/activation system 10 according to the present invention is schematically shown. The polymer mixing-/activation system 10 includes a liquid-inlet line 12, a polymer inlet line 14, a mixer-ejector 16, an ejector outlet line 18, a mixing/retention chamber 20, and a chamber outlet line 22. As is explained in more detail below, these components coordinate in such a manner that the system 10 uses only the pressure of the incoming liquid to regulate the introduction of the polymer and/or to aid in the mixing of the liquid and the polymer. Thus, the polymer mixing/activation system 10 does not require an outside source of power, such as electricity, to operate.

The liquid inlet line 12 is adapted to be connected to a source of pressurized liquid. In the preferred embodiment, the source of pressurized liquid is a city water line whereby the liquid is pressurized (10 to 100 p.s.i.) city water. The liquid line 12 may include a control valve 24, a flow meter 26, and/or a pressure meter 28. The flow meter 26 may be used to regulate the volume of the incoming liquid and the pressure meter 28 may be used to monitor the liquid pressure.

The polymer inlet line 14 is adapted to be connected to a source of a suitable polymer. Particularly, a polymer is selected which, when mixed with the liquid and activated, will be suitable to attract, coagulate or flocculate suspended solids in a fluid, such as waste water. The polymer line 14 may include a control valve 30 which regulates the volume of the incoming polymer and/or a suction gauge 32 which monitors the pressure of the polymer.

In the preferred embodiment, the mixer-ejector 16 is of the form disclosed in U.S. Pat. No. 4,123,800, the entire disclosure of which is hereby incorporated by reference. Thus, the preferred mixer-ejector 16 includes a primary entrance 34, an additive entrance 36, and a discharge 38. The upstream end of the liquid line 12 is connected to the primary entrance 34 and an upstream end of the polymer line 14 is connected to the additive entrance 36. Thus, the liquid inlet line 12 and the polymer inlet line 14 are connected to the mixer-ejector 16. Additionally, a downstream end of the ejector outlet line 18 is connected to the discharge 38.

Although not specifically shown and/or numbered in the drawing, the mixer-ejector 16 has passageways arranged and shaped so that when the liquid flows therethrough a suction is created which draws the polymer into the mixer-ejector 16 and simultaneously mixes the polymer with the liquid to form a liquid/polymer mixture. Specifically, the mixer-ejector 20 includes a downstream constricting portion of decreasing diameter, an upstream expanding portion of increasing diameter, and a throat portion which interconnects the downstream portion and the upstream portion. These portions form a primary flow channel from the primary entrance 34 to the discharge 38. Further, ports are provided between the additive entrance 36 and a section of the throat portion which is adjacent to the constricting portion. In this manner, when the liquid travels through the mixer-ejector 20, its velocity/pressure changes and a suction is created. This suction draws the polymer through the additive entrance 36 and simultaneously mixes the polymer with the liquid to form a liquid/polymer mixture. The liquid/polymer mixture exits the mixer-ejector 16 through the discharge 38 and flows through the ejector outlet line 18.

The mixing/retaining chamber 20 includes an entrance 40 which is connected to an upstream end of the ejector outline 18 and an exit 42 which is connected to a downstream end of the outlet line 22 of the chamber 20. The size of the mixing/retaining chamber 20 will depend on the particular application of the polymer mixing/activation system 10. However, applicants contemplate that in many applications involving city water, this capacity will be approximately one gallon. Additionally or alteratively, applicants contemplate that the chamber 20 will be sized to provide a ½ to 1 minute retention of the liquid/polymer mixture.

In the preferred and illustrated mixing/retention chamber 20, various zones are provided for the mixing and/or retention of the liquid/polymer mixture. More specifically, a first zone 44 is provided adjacent the chamber's inlet 40, a middle zone 46 is provided adjacent the first zone 44, and a final zone 48 is provided between the middle zone 46 and the chamber's outlet 42. Thus, the liquid/polymer mixture travels from the ejector outlet line 18, through the chamber's entrance 40, sequentially through the zones 44, 46 and 48, through the chamber's exit 42, and into the chamber outlet line 22. The liquid/polymer mixture is then adequately mixed and activated and may be used in, for instance, waste water treatment.

The first zone 44 comprises a manifold for evenly distributing the flow of the liquid/polymer mixture into the middle zone 46. In the preferred and illustrated embodiment, the manifold includes gradually increasing (in the upstream direction) cone-shaped orifices. This orifice shape is believed to prevent "fish eyes." The final zone 48 may comprises a similar manifold.

The middle zone 46 preferably includes a series of substantially sphere-shaped objects 50 which increase in size towards the upstream end of the zone. In this manner, a high turbulence is initially created by the relatively small size of the downstream spheres. However, as the liquid/polymer mixture continues through the middle zone 46, the increasing size of the spheres causes a decrease in turbulence whereby the flow profile of the mixture becomes more gentle. Applicants contemplate that, in most applications, the objects 50 will be plastic balls with diameters increasing from approximately ⅜ inch to one inch.

One may now appreciate that the present invention 10 provides a polymer mixing/activation system which uses only the pressure of the incoming liquid to regulate the introduction of the polymer and/or to aid in the mixing of the liquid and the polymer. Thus, the polymer mixing/activation system does not require an outside source of power, such as electricity, to operate. Moreover, the system is also believed to provide a more gentle and thorough mixing of the liquid and the polymer.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A polymer mixing/activation system comprising
a mixer-ejector,
a polymer inlet line connected to said mixer-ejector for charging polymer into said mixer-ejector in response to a suction created in said mixer-ejector,
a liquid inlet line connected to said mixer-ejector for charging a pressurized liquid into said mixer-ejector to thereby create a suction in said mixer-ejector, said suction drawing polymer into said mixer-ejector where said polymer and said liquid mix to form a liquid/polymer mixture, and
a mixing/retaining chamber in fluid communication with said mixture-ejector for receiving said liquid/-polymer mixture, said mixing/retaining chamber including a zone containing a series of substantially sphere-shaped objects which increase in size towards an upstream end of said zone.

2. A polymer mixing/activation system as set forth in claim 1 wherein said substantially sphere-shaped objects comprises plastic balls with diameters increasing from approximately ⅜ inch to one inch.

3. A polymer mixing/activation system comprising
a mixer-ejector,
a liquid inlet line connected to said mixer-ejector for charging polymer into said mixer-ejector in response to a suction created in said mixer-ejector,
a liquid inlet line connected to said mixer-ejector for charging a pressurized liquid into said mixer-ejector to thereby create a suction in said mixer-ejector, said suction drawing polymer into said mixer-ejector where said polymer and said liquid mix to form a liquid/polymer mixture, and
a mixing/retaining chamber in fluid communication with said mixture-ejector for receiving said liquid/-polymer mixture, said mixing/retaining chamber including a first zone provided adjacent said inlet of said chamber's entrance, said first zone comprising a manifold for evenly distributing flow of said liquid/polymer mixture into said middle zone, said manifold of said first zone including gradually increasing, in the upstream direction, cone-shaped orifices, a middle zone and a final zone, whereby said liquid/polymer mixture travels from said mixer-ejector sequentially through said first middle and final zones in said chamber.

4. A polymer mixing/activation system as set forth in claim 3 wherein said middle zone includes a series of substantially sphere-shaped objects which increase in size towards an upstream end of said zone.

5. A polymer mixing/activation system as set forth in claim 4 wherein said substantially sphere-shaped objects comprises plastic balls with diameters increasing from approximately ⅜ inch to one inch.

6. A polymer mixing/activation system as set forth in claim 4 wherein said final zone comprises a manifold.

7. A polymer mixing/activation system as set forth in claim 6 wherein said manifold of said final zone includes gradually increasing, in the upstream direction, cone-shaped orifices.

8. A polymer mixing/activation system as set forth in claim 3 wherein said mixing/retaining chamber has an approximately one gallon capacity.

9. A polymer mixing/activation system as set forth in claim 3 wherein said mixing/retaining chamber is sized to provide a ½ to 1 minute retention of such liquid/-polymer mixture.

10. A polymer mixing/activation system comprising:
a city water line carrying pressurized water;
a source of emulsion polymer which, when mixed with such water and activated, forms a liquid/-polymer solution suitable to attract, coagulate or flocculate suspended solids in waste water;
means for introducing said polymer into said liquid and for simultaneously mixing said polymer with said liquid to form the liquid/polymer solution, said means using only the pressure of said liquid whereby an outside power source is unnecessary.

11. The polymer mixing/activation system of claim 10 wherein said city water line is a city waste water line carrying city waste water.

12. A polymer mixing/activation system comprising:
a water line carrying pressurized water;
a source of emulsion polymer which, when mixed with water and activated, forms a water/polymer solution suitable to attract, coagulate or flocculate suspended solids in waste water;
means for introducing said polymer into said water and for simultaneously mixing said polymer with said water to form the water/polymer solution, said means consisting essentially of a mixer-ejector having passageways arranged and shaped so that when said water flows therethrough a suction is created by such flow which draws said polymer into said mixer-ejector and simultaneously mixes such polymer with said water to form a water/-polymer mixture, said drawing and mixing being accomplished without the aid of an outside power source.

13. The polymer mixing/activation system of claim 12 wherein said city water line is a water line carrying city waste water.

14. The system of claim 12 further comprising a valve for regulating the volume of polymer drawn into said mixer-ejector.

15. A process for forming a liquid/polymer solution suitable to attract, coagulate or flocculate suspended solids in waste water comprising
charging pressured water into a mixer-ejector, said mixer-ejector having a water inlet line for receiving said pressurized water and a polymer inlet line for receiving an emulsion polymer, said polymer inlet line being connected to a source of emulsion polymer so that said emulsion polymer will be drawn into said mixer-ejector in response to a suction created therein, charging of said water into said mixer-ejector creating a suction in said mixer-ejector to thereby draw said emulsion polymer into said mixer-ejector and thereby form a liquid/-polymer mixture therein; and
charging said liquid/polymer mixture into a mixing-/retaining chamber in communication with said mixer-ejector for adequately mixing and activating said emulsion polymer and water for use in waste water treatment;
said polymer being drawn into said mixer-ejector and mixing of said liquid and polymer occurring solely as a result of the pressure of said liquid charged into said mixer-ejector whereby an outside source of power to carry out said mixing and activation is not required.

16. The process of claim 15 wherein said liquid/-polymer mixture is retained in said mixing/retaining chamber for about ½ to 1 minute retention time.

17. The process of claim 15 wherein said pressurized liquid is water received directly from a city water line and wherein the liquid/polymer mixture passing out of said chamber is added to waste water for the coagulation or flocculation of suspended solids therein.

18. The process of claim 15 further comprising regulating the volume of said polymer drawn into said mixer-ejector.

19. The process of claim 18 wherein regulating is accomplished with a valve.

* * * * *